US006802256B1

(12) United States Patent
Koch

(10) Patent No.: US 6,802,256 B1
(45) **Date of Patent: *Oct. 12, 2004**

(54) METHOD AND DEVICE FOR PREVENTING UNCONTROLLED SPREAD OF POWDER IN A PRINTING MACHINE

(75) Inventor: Hans-Peter Koch, Hamburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/619,975

(22) Filed: Jul. 20, 2000

Related U.S. Application Data

(63) Continuation of application No. PCT/EP99/00271, filed on Jan. 19, 1999.

(30) Foreign Application Priority Data

Jan. 20, 1998 (DE) ..... 198 01 949
Nov. 16, 1998 (DE) ..... 198 52 714

(51) Int. Cl.[7] ..... B41L 7/08

(52) U.S. Cl. ..... 101/416.1; 101/424; 101/424.1; 347/102; 118/312; 118/326; 271/207

(58) Field of Search ..... 101/424.2, 416.1, 101/419, 424, 423, 424.1; 347/101, 102, 105; 118/50, 312, 326; 198/495, 496

(56) References Cited

U.S. PATENT DOCUMENTS 1,360,753 A * 11/1920 Johnson ..... 432/230
1,944,946 A * 1/1934 Nordquist ..... 101/416.1
3,273,496 A * 9/1966 Melmon ..... 101/114
3,399,872 A * 9/1968 Dickerson ..... 432/62
3,677,224 A * 7/1972 Noon ..... 118/63
3,717,408 A * 2/1973 Radin et al. ..... 399/217
3,775,806 A * 12/1973 Olbrant et al. ..... 15/309.1
3,819,032 A * 6/1974 Preuss et al. ..... 198/495

(List continued on next page.)

FOREIGN PATENT DOCUMENTS

| | | | | |
|---|---|---|---|---|
| DE | 2 148 757 | | 9/1972 | |
| EP | 0230147 A2 | * | 7/1987 | ..... B05B/15/12 |
| JP | 02-150177 | | 2/1992 | |
| JP | 09057945 | | 3/1997 | |
| JP | 410271945 A | * | 10/1998 | ..... A22C/17/06 |
| WO | PCT/EP93/00432 | | 9/1993 | |
| WO | WO 99/37484 | * | 7/1999 | ..... B41F/23/06 |

*Primary Examiner*—Donald P. Walsh
*Assistant Examiner*—Jeffrey A. Shapiro
(74) *Attorney, Agent, or Firm*—Laurence A. Greenberg; Werner H. Stemer; Gregory L. Mayback

(57) ABSTRACT

A method for conveying sheets, which have been printed in a printing machine, through a sheet delivery system above a sheet deposit pile by a sheet conveying device and, at the same time, dusting the sheets with a powder, and preventing uncontrolled spread of excess powder, includes interrupting a powder-laden air flow extending in a direction towards the printing machine along an empty strand of the sheet conveying device in a housing of the sheet delivery system at least at one interruption location between a free end of the sheet delivery system and the printing machine, so that transport of entrained powder in a direction towards the printing machine is prevented; a prevention device for performing the method; a sheet delivery system including the prevention device; and a sheet-fed printing machine in combination with the sheet delivery system.

46 Claims, 5 Drawing Sheets

U.S. PATENT DOCUMENTS 3,881,653 A * 5/1975 Birckhead ..... 239/698
3,882,818 A * 5/1975 Mowbray ..... 118/312
3,915,737 A * 10/1975 Sroka ..... 134/1
4,040,616 A * 8/1977 Clarkson et al. ..... 271/65
4,207,833 A * 6/1980 Napadow ..... 118/324
4,212,266 A * 7/1980 Payne et al. ..... 118/712
4,514,779 A * 4/1985 Wilkinson ..... 361/213
4,611,989 A * 9/1986 Kersting ..... 198/495
4,888,200 A * 12/1989 Milliken ..... 118/630
4,902,315 A * 2/1990 Spicer ..... 454/238
4,946,718 A * 8/1990 Napadow ..... 427/424
4,960,200 A * 10/1990 Pierce ..... 198/495
5,086,700 A * 2/1992 Van Den Berg ..... 101/424.1
5,092,696 A * 3/1992 Armiroli et al. ..... 400/611
5,245,925 A * 9/1993 Switall et al. ..... 101/423
5,259,608 A * 11/1993 Pollich ..... 271/183
5,265,536 A * 11/1993 Millard ..... 101/424.2
5,293,985 A * 3/1994 Alvarez ..... 15/21.1
5,397,394 A * 3/1995 Orr ..... 118/312
5,443,005 A * 8/1995 Platsch ..... 101/416.1
5,537,925 A * 7/1996 Secor et al. ..... 101/424.1
5,540,152 A * 7/1996 DeMoore ..... 101/240
5,570,789 A * 11/1996 Dunn ..... 209/12.2
5,598,915 A * 2/1997 Malmberg et al. ..... 198/495
5,634,401 A * 6/1997 Weaver ..... 101/216
5,649,616 A * 7/1997 Stecklow ..... 198/495
5,671,676 A * 9/1997 Baba et al. ..... 101/425
5,671,838 A * 9/1997 Bowman ..... 198/496
5,713,285 A * 2/1998 Reed et al. ..... 101/416.1
5,746,302 A * 5/1998 Bowman ..... 15/256.5
5,758,580 A * 6/1998 Murray ..... 101/147
5,782,183 A * 7/1998 Andrews, Jr. ..... 101/232
5,816,155 A * 10/1998 Stephan ..... 101/232
5,931,095 A * 8/1999 Platsch ..... 101/424.2
5,966,836 A * 10/1999 Valdez et al. ..... 101/424.1
6,071,558 A * 6/2000 Shutic ..... 427/180
6,085,654 A * 7/2000 Gunschera et al. ..... 101/424.2
6,129,020 A * 10/2000 Speck ..... 101/425
6,170,427 B1 * 1/2001 Scheufler et al. ..... 118/620
6,182,567 B1 * 2/2001 Gunschera et al. ..... 101/232
6,220,693 B1 * 4/2001 Bode et al. ..... 347/34
6,244,423 B1 * 6/2001 Tacchi et al. ..... 198/495
6,273,417 B1 * 8/2001 Berlingen et al. ..... 271/183
6,427,594 B1 * 8/2002 Secor et al. ..... 101/424.1

* cited by examiner

METHOD AND DEVICE FOR PREVENTING UNCONTROLLED SPREAD OF POWDER IN A PRINTING MACHINE

CROSS REFERENCE TO RELATED APPLICATION

This is a continuation of copending International Application PCT/EP99/00271, filed Jan. 19, 1999, which designated the United States.

BACKGROUND OF THE INVENTION

Field of the Invention

The invention relates to a method and a device for preventing uncontrolled spread of powder in a printing machine. The invention relates in particular to a method in which sheets printed in a sheet-fed printing machine are conveyed through a sheet delivery system above a sheet deposit pile by a sheet conveying device and, in the process, are dusted with a powder, and wherein uncontrolled spreading of excess powder is prevented, and to a device for preventing uncontrolled spreading of powder in a housing of a sheet delivery system of a sheet-fed printing machine, the housing surrounding a sheet conveying device for transporting printed sheets over a sheet deposit pile, and a dusting device for dusting the printed sheets with a powder. Furthermore, the invention relates to a sheet delivery system for a sheet-fed printing machine and to a sheet-fed printing machine having such a device for preventing the uncontrolled spreading of powder.

During sheet-fed offset printing in larger sheet-fed offset printing machines, the paper sheets printed on one or both sides, after passing through the printing units of the printing machine, are usually picked up by a chain conveyer of the paper or sheet delivery system, i.e., a chain conveyer having two parallel chains connected by delivery gripper systems or sheet grippers and, within a housing that encloses the sheet delivery system and the printing units of the printing machine, are transported to a location over a sheet pile, whereon they are subsequently deposited above one another. Because the printing ink has not yet completely dried when the sheets are piled above one another, in most of the sheet-fed offset printing machines on the market, at least one surface of each sheet, before the sheet is deposited on the pile, is dusted with a powder which sticks to the printed parts of the paper sheets and prevents set-off, i.e., a sticking together of the paper sheets in the sheet pile. The powder that is used is usually finely powdered potato starch or other powdery starch products. In order to apply the powder, use is made of a so-called spray powder device or any other dusting device which, as a rule, is arranged in an intermediate space between the forward-running conveyor strand transporting the sheets and the returning empty strand of the chain conveyer, and dusts, with powder from above, the sheets which are carried by the lower conveyor strand of the chain conveyer and transported past the powder device.

High-speed sheet-fed offset printing machines for printing large editions, such as the sheet-fed offset printing machines sold by Heidelberger Druckmaschinen AG under the designation Heidelberg Speedmaster, are usually provided with a high-pile sheet delivery system, in order to be able to stack or pile up more sheets. In such sheet delivery systems, the conveying strand of the chain conveyer initially extends obliquely upwardly and is then deflected into the horizontal, in order to align the printed sheets horizontally before releasing them over the sheet deposit pile. The dusting device is disposed thereat usually just before the upper end of the oblique portion of the conveying strand, in the interspace between the latter and the empty strand of the chain conveyor.

During the operation of sheet-fed offset printing machines of this type, it has been determined that considerably more powder is consumed than is actually necessary for dusting the paper sheets. At the same time, the ambient air around the sheet delivery system has a considerably increased dust content, caused by powder particles, while deposits of powder form to an increased extent on movable and immovable parts in the interior of the housing of the sheet delivery system. The high dust content in the ambient air which, to some extent, can be referred to as a virtual powder mist, is found to be extremely unpleasant by the operating personnel, while deposits of powder in the interior of the housing, in particular on movable parts, lead to increased wear and relatively long downtimes of the machine, due to a requirement for more frequent cleaning and maintenance work.

During investigations and testing by the applicant to clarify the causes of the dust loading caused by powder in the ambient air, as well as the powder deposits in the housing of the sheet delivery system, it has been established that air turbulence occurs to a great extent in the sheet delivery systems of conventional offset printing machines. This air turbulence is caused, inter alia, by the fact that, in each case, underneath and above the conveying strand and the empty strand of the sheet delivery, air is entrained in the direction of motion of the respective strand as a result of the suction action of the moving sheet grippers and chains, by the fact that printed sheets entrained by the conveying strand flutter or, when being deflected from the oblique into the horizontal position, flip upwardly at the rear or trailing edge thereof (a so-called whipping or flapping effect), and by the fact that air is blown from below towards the sheet from the so-called sheet guiding plate, in order to guide the sheet over the guide plate without contact, but some of this air flows upwardly between the adjacent sheets and laterally past the respective sheet.

Due to this air turbulence, a great part of the powder emerging from the powder dusting device is swirled about and entrained by the air so that it does not pass onto the surface of the printed material directly underneath the powder dusting device, as desired. Instead, the powder is distributed over the entire interior of the sheet delivery system by the airflows, in particular those along the two strands of the sheet delivery. This results not only in increased wear of moving parts and longer downtimes for cleaning the sheet delivery system, but also to irritation or disturbance of the operating personnel, because the swirled powder also escapes into the environment through all the openings in the sheet delivery system, in particular through the sheet outlet opening and air outlet gratings on the top of the housing.

In order to reduce the high dust loading of the ambient air and to eliminate further problems caused by excessive powder, in U.S. Pat. No. 5,265,536, a suction hood arranged above the sheet pile and a sheet outlet opening is proposed, which serves for extracting or sucking powder-laden air upwardly through the empty strand, in order then to clean the air. Some of the powder-laden air, however, is entrained by the suction of the empty strand as it passes therethrough and flows along the empty strand in the direction of the printing machine.

In addition, the published German Patent Document DE 42 07 118 A1 discloses a sheet delivery system in a sheet-fed printing machine, having a housing wherein, in the vicinity of the powder dusting device above the delivery strand, devices are provided for extracting or sucking excessive powder and, therefore, for preventing the uncontrolled spreading thereof. Devices of this type immediately extract or suck up a large portion of the applied powder again, but this often has the result that the operating personnel increase the supply of powder, and in this way even more powder is consumed. On the other hand, the problem of powder spread due to air suction in the interior of the housing is not solved.

In addition, the German Published Prosecuted Patent Application (DE-AS) 2 148 757 discloses a sheet delivery system in a printing machine wherein, along an upper horizontal portion of the empty strand of a sheet conveyer, a cleaning device is provided, which includes a housing, a number of brushes arranged in the housing and an extraction or sucking device for extracting or sucking away the powder cleaned off the chains and gripper systems by the brushes. However, in this published German patent application, neither the problem of the spread of powder due to the powder-laden air entrained by the suction of the empty strand was detected, nor is the described cleaning device suitable for preventing the transport of powder-laden air in the direction of the printing machine, because there are wide, open flow cross sections both between the housing of the cleaning device and the adjacent walls of the sheet delivery system and also within the housing on both sides of the brushes, and these permit the passage of powder-laden air along the path of movement of the empty strand.

SUMMARY OF THE INVENTION

Starting from this state of the art, it is an object of the invention to provide a method and a device of the general type mentioned at the introduction hereto, which can be assembled after leaving the factory and/or at the factory, which permits a reduction in the dust loading in the environment of the printing machine during the printing operation and which largely prevents the formation of powder deposits within the housing.

With the foregoing and other objects in view, there is provided, in accordance with one aspect of the invention, a method for conveying sheets, which have been printed in a printing machine, through a sheet delivery system above a sheet deposit pile by a sheet conveying device and, at the same time, dusting the sheets with a powder, and preventing uncontrolled spread of excess powder, which comprises interrupting a powder-laden air flow extending in a direction towards the printing machine along an empty strand of the sheet conveying device in a housing of the sheet delivery system at least at one interruption location between a free end of the sheet delivery system and the printing machine, so that transport of entrained powder in a direction towards the printing machine is prevented.

In accordance with another mode, the method of the invention includes substantially completely blocking a flow path between an upper wall or cover of the housing, side walls of the housing and a device that is disposed underneath the empty strand and above a conveying strand of the sheet conveying device and that serves as a dividing wall, so as to prevent powder-laden air from passing by to the printing machine.

In accordance with a further mode, the method includes interrupting the airflow in an upper horizontal portion of the sheet delivery system.

In accordance with an added mode, the method includes interrupting the airflow above a drive shaft of a lifting mechanism for the sheet deposit pile.

In accordance with an additional mode, the method includes feeding air not laden with powder into the housing in a manner that the air flows through the empty strand transversely to the direction of motion thereof, so as to interrupt the airflow.

In accordance with yet another mode, the method includes feeding the air into the housing from above.

In accordance with yet a further mode, the method includes feeding-in the air in a direction of motion of the empty strand and downline of a brush device at least partly blocking the flow path.

In accordance with yet an added mode, the method includes deflecting at least some of the air that is fed-in, in the direction towards the printing machine.

In accordance with yet an additional mode, the method includes guiding at least some of the deflected air in the direction towards the printing machine over and past a dusting device for dusting the sheets with powder.

In accordance with still another mode, the method includes extracting powder-laden air in the vicinity of the interruption location, so as to interrupt the airflow.

In accordance with still a further mode, the method includes extracting at least some of the air fed into the housing, after the air has passed through the empty strand.

In accordance with still an added mode, the method includes extracting the air nearly opposite the location at which it is fed into the housing.

In accordance with still an additional mode, the method includes extracting the powder-laden air in the vicinity of a brush device that at least partly blocks the flow path.

In accordance with another mode, the method includes, in at least one of the region of the interruption location and a location downline thereof in the direction of motion of the empty strand, sucking air into the housing from the outside through at least one air opening.

In accordance with a further mode, the method includes interrupting the airflow with a brush device at least nearly completely blocking the flow path.

In accordance with a second aspect of the invention, there is provided a device for preventing uncontrolled spread of powder in a housing of a sheet delivery system of a sheet-fed printing machine, the housing surrounding a sheet conveying device for transporting printed sheets over a sheet deposit pile and a dusting device for dusting the printed sheets with a powder, comprising devices for interrupting a powder-laden air flow extending in a direction towards the printing machine along an empty strand of the sheet conveying device, the flow-interrupting devices being mountable at at least one interruption location between a free end of the sheet delivery system and the printing machine for preventing transport of entrained powder in the direction towards the printing machine.

In accordance with another feature of the invention, the flow-interrupting devices at least nearly completely block, by at least one mechanical and pneumatic device, a flow path between an upper wall or covering of the housing, side walls of the housing and a device that is disposed underneath the empty strand and above a conveying strand of the sheet conveying device and serves as a dividing wall, for preventing powder-laden air from passing by to the printing machine.

In accordance with a further feature of the invention, the flow-interrupting devices include at least one air feed device for feeding air not laden with powder into the housing, so that the air flows through the empty strand transversely to a direction of motion of the latter.

In accordance with an added feature of the invention, the flow-interruption devices include at least one extraction device for extracting powder-laden air in the region of the interruption location.

In accordance with an additional feature of the invention, the extraction device is disposed at least nearly opposite an air feed device for extracting at least some of the air fed into the housing by the air feed device after the air has passed through the empty strand.

In accordance with yet another feature of the invention, the extraction device and the air feed device are arranged above one another.

In accordance with yet a further feature of the invention, the extraction device is disposed underneath the empty strand and has at least one suction opening at the top thereof, facing towards the empty strand.

In accordance with yet an added feature of the invention, in the direction of motion of the empty strand, the air feed device is disposed downline from a brush device which at least partly blocks the flow path.

In accordance with yet an additional feature of the invention, the extraction device is disposed in vicinity of a brush device which at least partly blocks the flow path.

In accordance with still another feature of the invention, the flow-interrupting devices include a brush device at least nearly completely blocking the flow path.

In accordance with still a further feature of the invention, the brush device includes at least two brushes having bristles which overlap or touch in a path of movement of the empty strand.

In accordance with still an added feature of the invention, in a region of the interruption location and/or a location downline therefrom in a direction of motion of the empty strand, at least one air opening is located for permitting air not laden with powder to be sucked into the interior of the housing.

In accordance with still an additional feature of the invention, the air opening is located at the top of the housing, above the empty strand.

In accordance with another feature of the invention, in a direction of motion of a conveying strand of the sheet conveying device, at least some of the flow-interrupting devices are mountable or mounted downline of the dusting device.

In accordance with a further feature of the invention, at least some of the flow-interrupting devices are mountable or mounted in an upper horizontal portion of the sheet delivery system.

In accordance with an added feature of the invention, at least some of the flow-interrupting devices are mountable or mounted above a blower or an air-nozzle device for blowing the printed sheets downwardly onto the sheet deposit pile.

In accordance with an additional feature of the invention, in a direction of motion of a conveying strand of the sheet conveying device, at least some of the flow-interrupting devices are mountable or mounted downline of a location at which the conveying strand is deflected into the horizontal.

In accordance with yet another feature of the invention, at least some of the flow-interrupting devices are mountable or mounted at least above or upline and downline of a drive shaft belonging to a lifting mechanism for the sheet deposit pile and passing through an intermediate space.

In accordance with yet a further feature of the invention, the prevention device includes a deflection device mountable or mounted underneath the empty strand for deflecting at least some air fed-in in a direction towards the printing machine.

In accordance with a third aspect of the invention, there is provided a sheet delivery system for a sheet-fed printing machine, having a housing, a conveying device arranged within the housing for transporting printed sheets to a sheet deposit pile, and a dusting device for dusting the printed sheets with a powder, comprising a device for preventing uncontrolled spread of powder in the housing of the sheet delivery system, including devices for interrupting a powder-laden air flow extending in a direction towards the printing machine along an empty strand of the sheet conveying device, the flow-interrupting devices being mountable or mounted at at least one interruption location between a free end of the sheet delivery system and the printing machine for preventing transport of entrained powder in the direction towards the printing machine.

In accordance with a fourth aspect of the invention, there is provided a sheet-fed printing machine in combination with a sheet delivery system having a housing, a conveying device arranged within the housing for transporting printed sheets to a sheet deposit pile, and a dusting device for dusting the printed sheets with a powder, comprising a device for preventing uncontrolled spread of powder in the housing of the sheet delivery system, including devices for interrupting a powder-laden air flow extending in a direction towards the printing machine along an empty strand of the sheet conveying device, the flow-interrupting devices being mountable or mounted at at least one interruption location between a free end of the sheet delivery system and the printing machine for preventing transport of entrained powder in the direction towards the printing machine.

In accordance with a concomitant feature of the invention, the sheet-fed printing machine includes devices for cleaning the air that has been fed-in and/or extracted.

Thus, an air flow loaded with excess powder, extending in the direction of the printing machine along an empty strand of the sheet conveying device in the housing of the sheet delivery system, as a result of previously passing the dusting device by, is interrupted at at least one interruption location between the free end of the sheet delivery system and the printing machine, in order to prevent the transport of entrained powder in the direction of the printing machine.

A preferred configuration of the invention therefore provides for each flow path along the movement path of the empty strand, through which powder-laden air can flow from the free end of the sheet delivery system towards the printing machine to be blocked at at least one location between the free end of the delivery and the printing machine, in order in this way to prevent the formation of an air flow extending in the direction of the printing machine and, therefore, to prevent the transport of powder in this air flow towards the printing machine. For this purpose, it is necessary, at the interruption location, to essentially completely block the entire free flow cross section between an upper wall of the housing, the two side walls of the housing and a dividing wall or the like arranged in the intermediate space between the empty strand and the conveying strand, so that the passage of powder-laden air through this section of the flow path is virtually completely suppressed.

According to a further preferred configuration of the invention, the air flow is interrupted as close as possible to the free end of the sheet delivery system, i.e., expediently in an upper horizontal portion of the sheet delivery system and preferably above a drive shaft of a lifting mechanism for the sheet deposit pile, whereat there is sufficient space for the necessary devices. Because the drive shaft rotates very slowly, it can additionally be used well as support or carrier for some of the devices.

The interruption to the airflow can be carried out using pneumatic and/or mechanical devices, a combination being preferred. In the case of interruption with a pneumatic device, air is preferably extracted from the housing at the interruption location, and/or a stream of clean air, i.e., air not laden with powder, is fed into the housing of the sheet delivery system, both in such a way that the flow path is blocked by an air curtain or air flow, which passes through the empty strand and is sufficiently broad and deep to prevent the passage of powder-laden air between the upper wall of the housing, the two side walls of the housing and the dividing wall or the like arranged between the empty strand and the conveying strand.

To this end, the devices serving to interrupt the air flow preferably comprise an air feed device, which conducts air extracted from the environment and not laden with powder into the housing in such a way that it flows vertically through the empty strand, transversely with respect to the direction of motion of the latter, and/or an air extraction device, which extracts air from the flow path, transversely with respect to the direction of motion of the empty strand, preferably opposite the air feed device, in order to extract at least some of the introduced air, together with the powder that has showered off the chains and sheet grippers of the conveying device, after it has passed through the flow path, and expediently to clean it of entrained powder in a separator connected downline.

The air fed-in is preferably led into the housing from above and extracted underneath the empty strand, in order to carry away powder that has showered off in the direction of gravity. However, a converse arrangement is likewise conceivable.

In order to ensure a formation of the air curtain which is disturbed as little as possible, a number of brushes are preferably provided upline of the air feed device in the direction of motion of the empty strand, the brushes extending over the entire width of the existing flow path and the bristles thereof projecting from above and below into the movement path of the empty strand and touching or overlapping thereat, in order in this manner to block the flow path over the entire height thereof as well and between the individual sheet grippers and, at the same time, to clean the sheet grippers and chains of adhering powder.

The cleaning of the chains and sheet grippers is likewise of importance for preventing the spread of powder, because powder entrained by the chain conveyer and later released by vibration or the-like is deposited in the housing of the sheet delivery system and, particularly in the vicinity of the last printing station of the printing machine, can lead to increased wear of sensitive components and to poor print quality.

According to a particularly preferred configuration of the invention, downline of a pair of brushes, air from the environment or atmosphere is blown from above into the housing of the sheet delivery system through the empty strand, and at least some of the air blown in is extracted again underneath the empty strand, so that powder-laden air that has passed through the brushes is entrained downwardly by the air fed from above and, underneath the empty strand, is extracted together with the powder detached from the chain conveyor by the brushes and/or powder showered off by blowing in air.

A further preferred configuration of the invention makes provision, in the region of the interruption location or downline thereof in the direction of motion of the empty strand, for air not laden with powder to be fed into the housing from outside. This prevents a negative pressure build-up in the direction of motion of the empty strand downline of the interruption location, which in turn could. lead to powder-laden air being sucked in in this region. Alternatively or additionally, the air feed and, if appropriate, the air extraction in the region of the interruption location can also be set so that the quantity of air fed in is greater than the quantity of air extracted, in order to avoid the production of negative pressure.

In addition, by feeding the air not laden with powder, the air suction generated by the empty strand can be used for guiding this air past, if necessary together with the air blown in and deflected at the top of an extraction and air deflection device also serving as a dividing wall, above the dusting device in the direction of the printing machine. This air not laden with powder then forms an air cushion between the dusting device and the empty strand and between the dusting device and the printing machine, which likewise at the same time contributes to preventing the spread of the powder as far as the vicinity of the printing machine.

Furthermore, on the underside of the air cushion, air vortices are formed, at the underside of which fresh air flows back in the direction of the free end of the delivery. This in turn has the effect that, between the dusting device and the extraction device, some of the swirled powder is deflected to one or more extraction openings at the rear edge of the extraction device, whereat it can be extracted. On the other hand, between the dusting device and the printing machine, fresh air flows back on the underside of the vortex in the direction of the dusting device, as a result of which the swirled powder immediately above the printed sheets is forced into the direction towards the free end of the delivery. Surprisingly, more uniform dusting of both sides of the sheets can be achieved in this way.

Other features which are considered as characteristic for the invention are set forth in the appended claims.

Although the invention is illustrated and described herein as embodied in a method and a device for preventing uncontrolled spread of powder in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
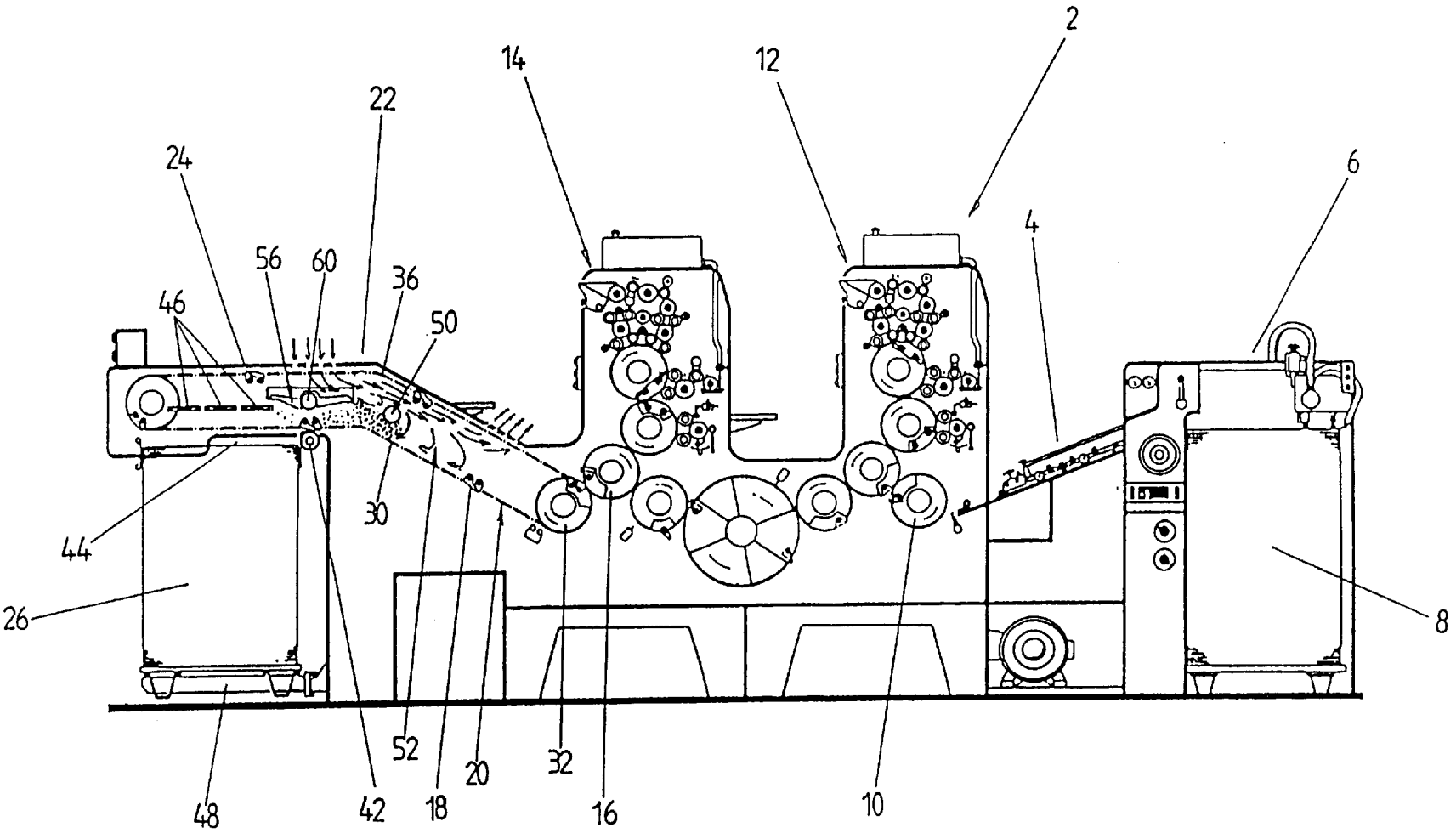
FIG. 1. is a diagrammatic side elevational view of a sheet-fed offset printing machine incorporating the device according to the invention.

Referring now to the drawings and, first, particularly to FIG. 1 thereof, there is shown therein, a two-color sheet-fed offset printing machine 2 wherein paper sheets are transferred successively by an automated sheet feeder 4 from a paper sheet pile 8 disposed in a sheet feeder 6 of the printing machine 2 to a feed drum 10 of a first printing unit 12, and then transported through the first printing unit 12 and, if appropriate, through a second printing unit 14, in order to print with one or more colors on one or both sides thereof.

Figure 3:
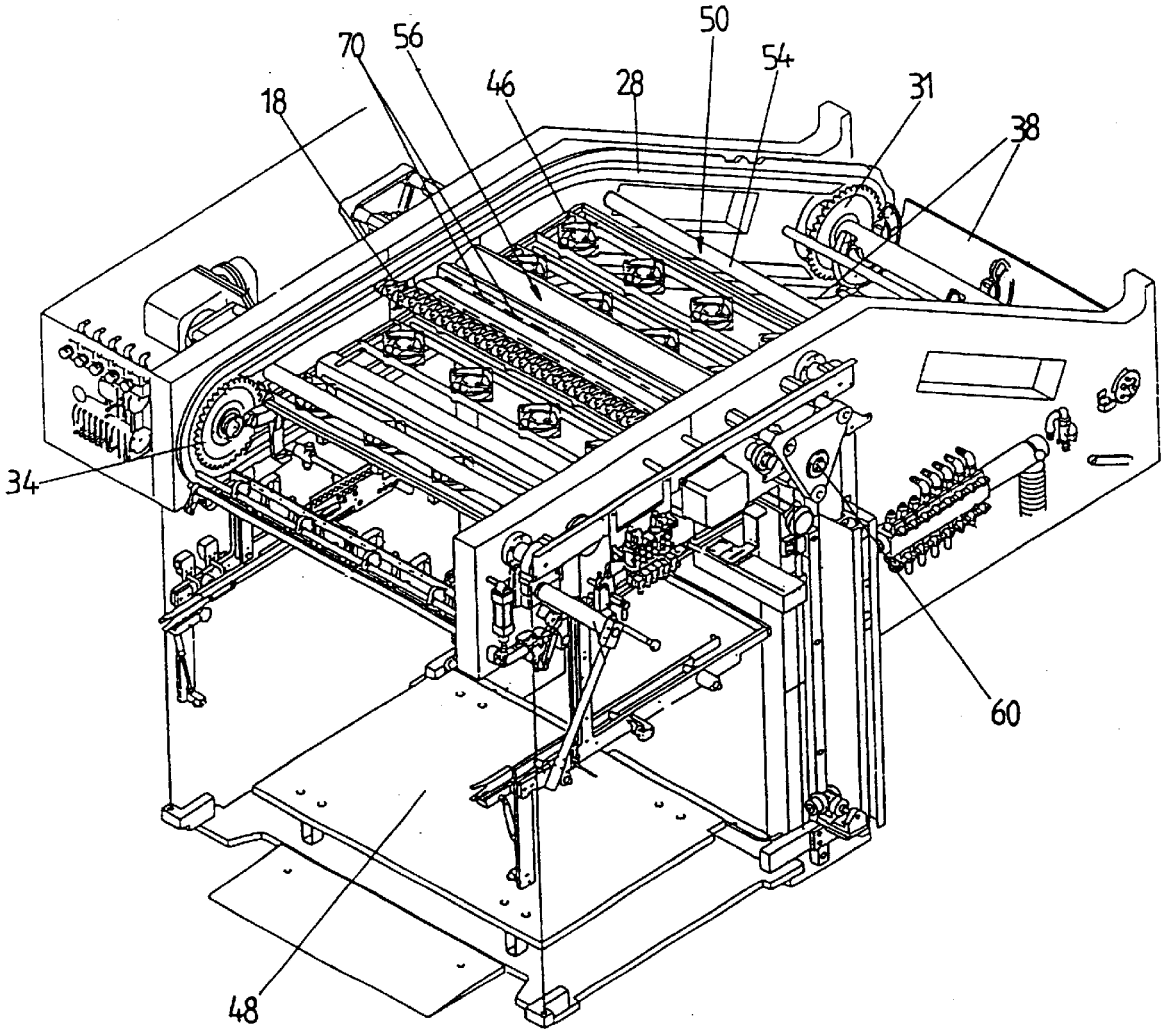
FIG. 3 is an end, side and top perspective view of a somewhat shorter sheet delivery system than that of FIG. 2, with the housing thereof removed and with the air feed device thereof omitted.

From an impression cylinder 16 of the second printing unit 14, delivery gripper systems 18 of a chain conveyor 20 of a sheet delivery system 22 belonging to the printing machine 2 accept the printed sheets and transport them through a housing 24 of the sheet delivery system 22 until they are above a sheet deposit pile or stack 26 whereon the sheets are then deposited above one another. The chain conveyor 20 essentially includes two nonillustrated parallel chains guided in opposite lateral guide rails 28 (FIG. 3), which are connected at regular intervals by gripper systems 18, also referred to herein as sheet grippers. The chain conveyor 20 has a lower conveying run or strand (forward-running system) 30 for transporting the sheets, the conveying strand 30 being moved obliquely upwardly by two sprockets 31 of a delivery drum 32, only one of which is shown in FIG. 3, and is then deflected into the horizontal before it reaches two drive sprockets 34 at the free end of the sheet delivery system 22. The upper empty strand or run (returning system) 36 of the sheet delivery system 22 is moved from the sprockets 34 (also note FIG. 3) horizontally in the direction of or towards the printing machine 2 before it is deflected obliquely downwardly and guided back to the delivery drum 32.

After being transferred to the sheet grippers 18, each sheet is guided in the direction of motion of the conveying strand or run 30 by sheet guide plates 38 (note FIGS. 2 and 3) and, without contact, past laterally adjustable sheet smoothing blowers 40 and over a sheet brake 42 disposed downline thereof, and thereafter reaches a sheet outlet opening 44 formed on the underside of the horizontal portion of the housing 24 of the sheet delivery system 22. Thereat, the sheets transferred to the sheet brake 42 by the grippers 18 and braked are blown downwardly onto the sheet deposit pile 26 with the aid of a number of delivery fans 46 arranged above the outlet opening 44. The sheet deposit pile 26 rests on a lifting mechanism 48, which lowers the pile 26 in synchronism with the sheet feed rate.

In the vicinity of the upper end of the oblique portion of the chain conveyor 20, shortly before the conveying strand or run 30 is deflected into the horizontal, a powder device 50 is arranged above the conveying strand 30, in an intermediate space 52 between the conveying strand 30 and the empty or slack strand 36. The powder device 50 dusts the top of the sheets, wet from printing and held by the sheet grippers 18 of the conveying strand 30, with a finely powdered starch powder, in order to prevent the sheets from sticking together (setting off) when they are thereafter piled above one another. The powder device 50 essentially includes a pipe 54 that extends through the intermediate space 52 transversely to the direction of motion of the chain conveyor 20 and has a number of powder outlet slots formed on the underside thereof. The starch powder is fed with the aid of a nonillustrated blower that is connected to the pipe 54, the metering rate depending upon the size and color intensity of the printed areas. In this regard, however, not only are the printed sheets but also the chains and sheet grippers 18 of the chain conveyor 20 dusted with the powder.

The paper sheets entrained by the chain conveyor 20 are deflected out of the oblique into the horizontal immediately downline of the powder device 50 in the direction of motion of the conveying strand 30. In this regard, the whipping or flapping effect mentioned hereinbefore at the beginning hereof takes place, i.e., the trailing edges of the paper sheets 1 wave upwardly or flutter. This, in turn, causes the powder emerging from the powder device 50 to swirl considerably immediately after emerging therefrom. This swirled powder is caught by the suction of the chain conveyor 20 and entrained by airflow caused by the suction and extending in the direction of motion of the chain conveyor 20.

In order to prevent the spread of the swirled powder within the housing 24 of the sheet delivery system 22 and, in particular, along the path of movement of the empty strand 36 in the direction towards the printing machine 2, to reduce the quantities of powder emerging through openings in the housing 24, and to clean the chains and sheet grippers 18 of the chain conveyor 20 which are dusted with powder, downline of the powder device 50, in the direction of motion of the delivery strand 30, there is arranged a combined extraction or suction and air deflection trough 56, to which fresh air can be applied from above through the empty strand 36, the trough being disposed in the intermediate space 52,between the delivery strand 30 and the empty strand 36. The fresh air that is not laden with powder is fed through a nozzle box 58, which is inserted into the closed upper wall of the housing 24 above the powder extraction or suction and air deflection trough 56, and which blows fresh air downwardly, in order to interrupt the powder-laden air flow extending in the direction towards the printing machine and thus prevent the transport of entrained powder in the direction towards the printing machine.

Figure 2:
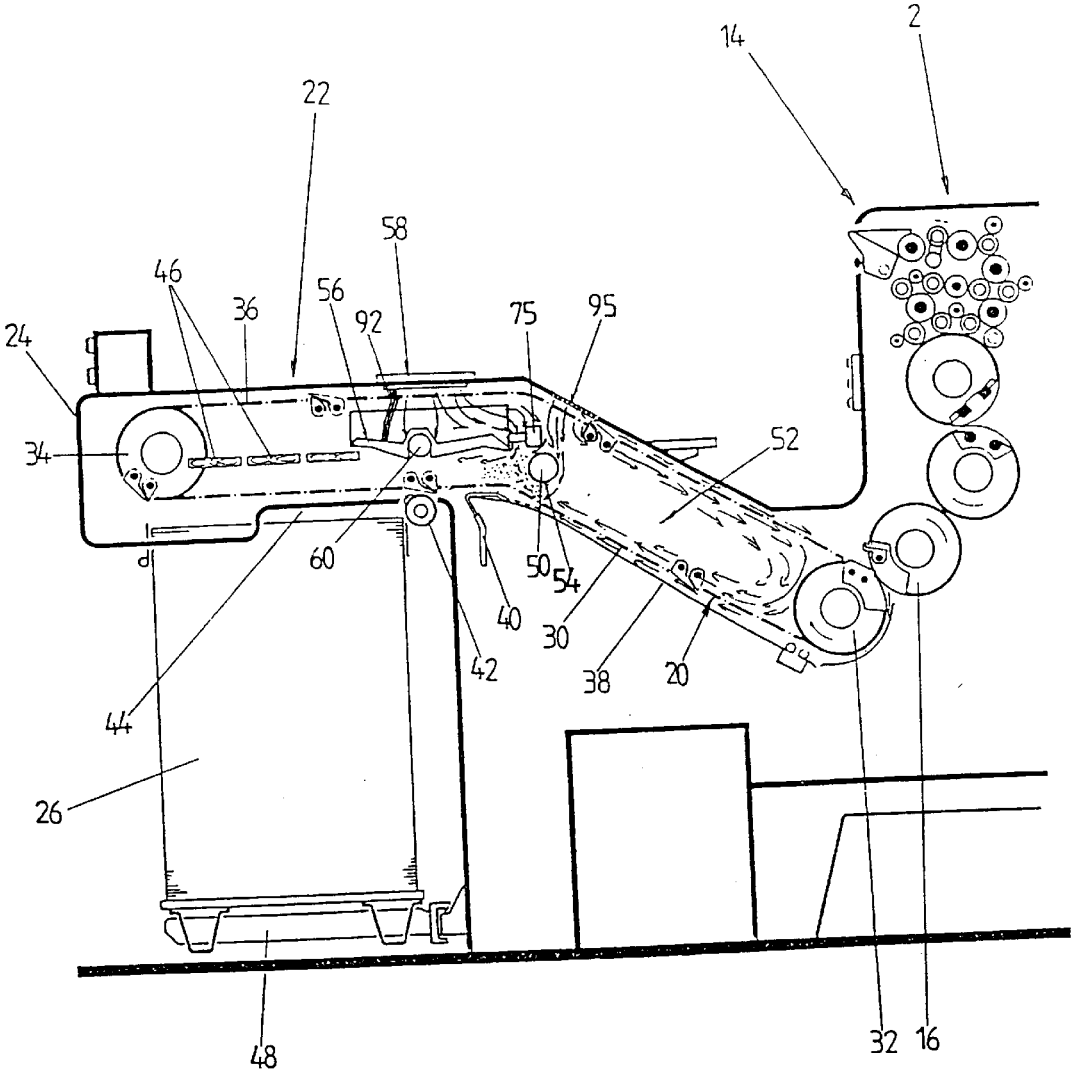
FIG. 2 is an enlarged fragmentary view of FIG. 1 showing a sheet delivery system somewhat modified over that of the printing machine of FIG. 1.

The powder extraction or suction and air deflection trough 56 and the nozzle box 58 are arranged downline of the location at which the conveying strand 30 is deflected into the horizontal; in the exemplary embodiment illustrated in FIGS. 1 and 2, the trough 56 and the box 58 are arranged upline from the sheet outlet opening 44, as viewed in the direction of motion of the conveying strand 30, and the delivery fans 46 located above the opening 44, while in the exemplary embodiment illustrated in FIG. 3, with a shorter sheet delivery system 22, the trough 56 and the box 58 are arranged immediately above the latter.

In both cases, the extraction or suction and air deflection trough 56 is carried by a drive shaft 60 belonging to the lifting mechanism 48, extends transversely and is arranged in the intermediate space 52 between the empty strand 36 and the conveying strand 30.

Figure 4:
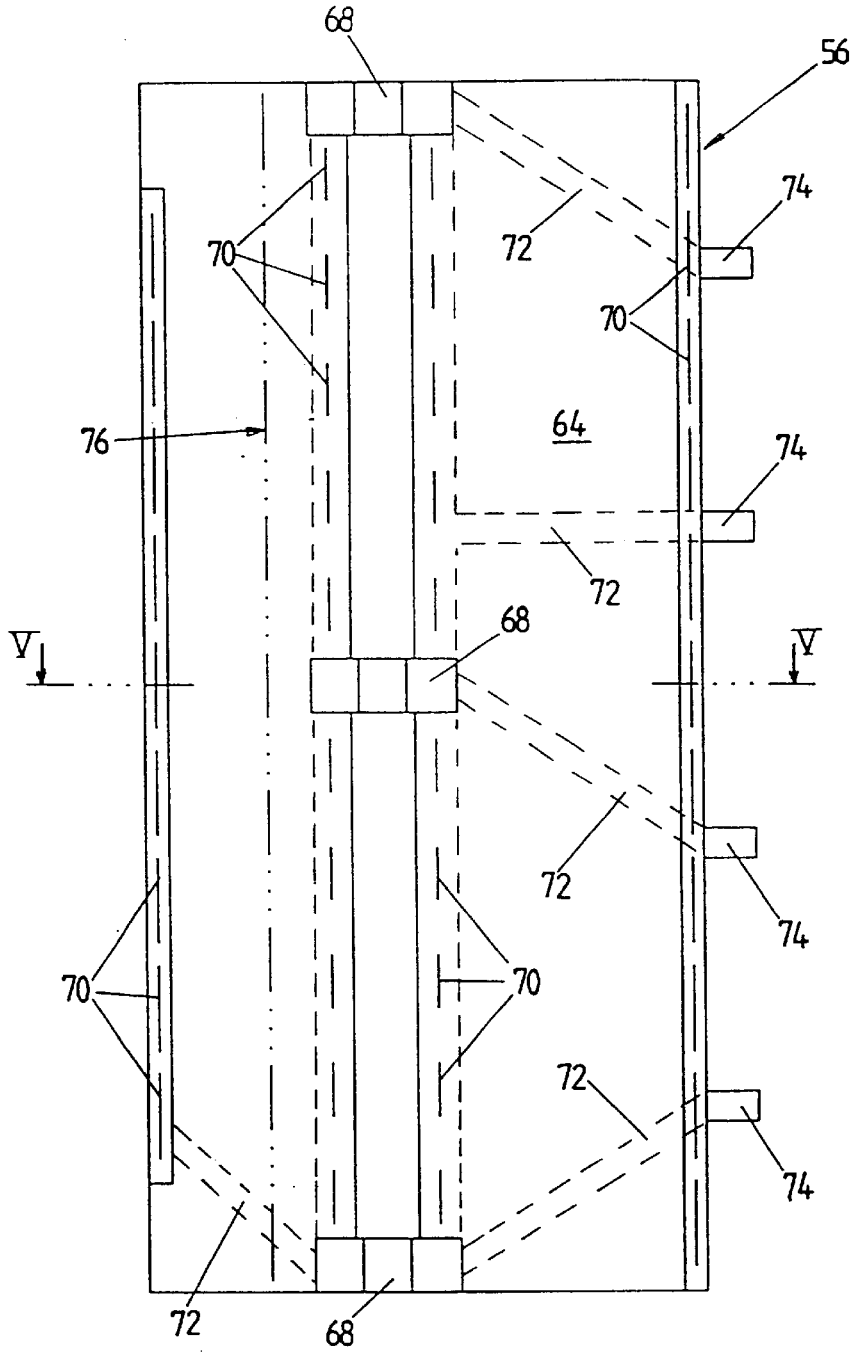
FIG. 4 is a top plan view of a combined extraction or suction and air deflection trough of the invention shown in FIGS. 2 and 3.
Figure 5:
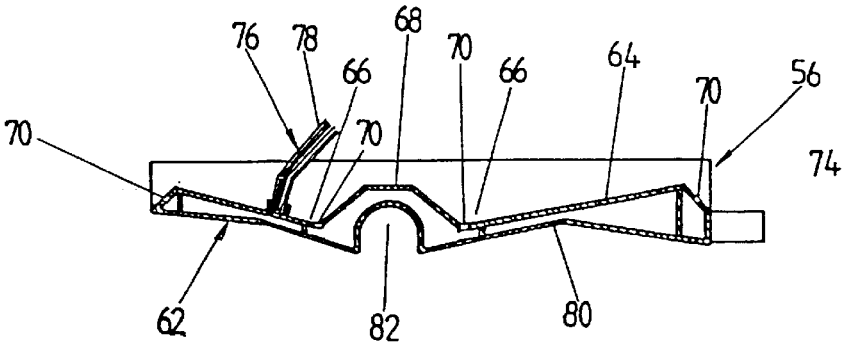
FIG. 5 is a cross-sectional view of FIG. 4 taken along the line V—V in the direction of the arrows.

As best illustrated in FIGS. 3, 4 and 5, the extraction or suction and air deflection trough 56 essentially includes a thin-walled flat housing 62. The housing 62 extends underneath the lateral guides of the empty strand 36, over the entire clear width of the housing 24 of the sheet delivery system 22, and forms a continuous dividing wall between a lower flow path extending along the conveying strand 30 and a path of movement of the empty strand 36 arranged above the flow path. Over the entire extent of this dividing wall air is prevented thereby from passing from top to bottom and opposite thereto.

The housing 62 has an upper housing wall 64 formed with bends therein several times in the direction of motion of the chain conveyor 20, so that two flat hollows 66 are formed, which are separated from one another by an elevated portion 68 arranged therebetween. The upper housing wall 64 is further provided with rows of suction slots 70 arranged at a distance from one another. While adjacent central rows of suction slots 70 are respectively disposed at the lowest locations in the hollows 66, outer rows of the slots 70 are arranged in the immediate vicinity of the opposite outer edges of the housing 62. Each of the rows of slots is connected, by a suction duct 72 provided within the housing 62, to a suction nozzle 74, the latter being located on one of the outer edges. The suction nozzles 74 are respectively connected, via directional and pressure regulating valves for controlling the quantities of air extracted and the vacuum applied, to a suction blower, upstream of which a dust separator with a centrifuge and a nonillustrated fine filter is connected. Of the rows of suction slots 70, the slots 70 at the outer edge on the side of the powder device 50 have the highest vacuum applied thereto.

Applied to the top of the upper housing wall 64, furthermore, is a cleaning brush 76, which extends over the entire width of the housing 62, the bristles 78 thereof, which are upwardly directed and disposed at a slight angle in the direction of motion of the empty strand 36, extending as far as the path of movement of the empty strand 36. The brush 76 is located in that hollow 66 which is swept over first by the empty strand 36 of the chain conveyor 20 moving away over the housing 62.

In addition, the housing 62 has a lower housing wall 80, which, between the two hollows 66 and underneath the elevated portion 68 of the upper housing wall 64, is provided with an upwardly sunken bulge 82 having a cross section in the shape of an inverted U. In the vicinity of this bulge 82, the housing wall 80 encloses a transversely extending drive shaft 60 disposed between the empty strand 36 and the conveying strand 30 and, at the top thereof, carrying the housing 62. In order to reduce the friction between the slowly rotating drive shaft 60 and the lower housing wall 80, the latter is provided with a Teflon coating in the region of the bulge 82.

Consequently, the extraction or suction and air deflection trough 56 is supported on the drive shaft 60, so that it needs to be fastened to opposite side cheeks of the chain conveyor 20 with only a few fastening screws in order to keep it in position.

Figure 6:
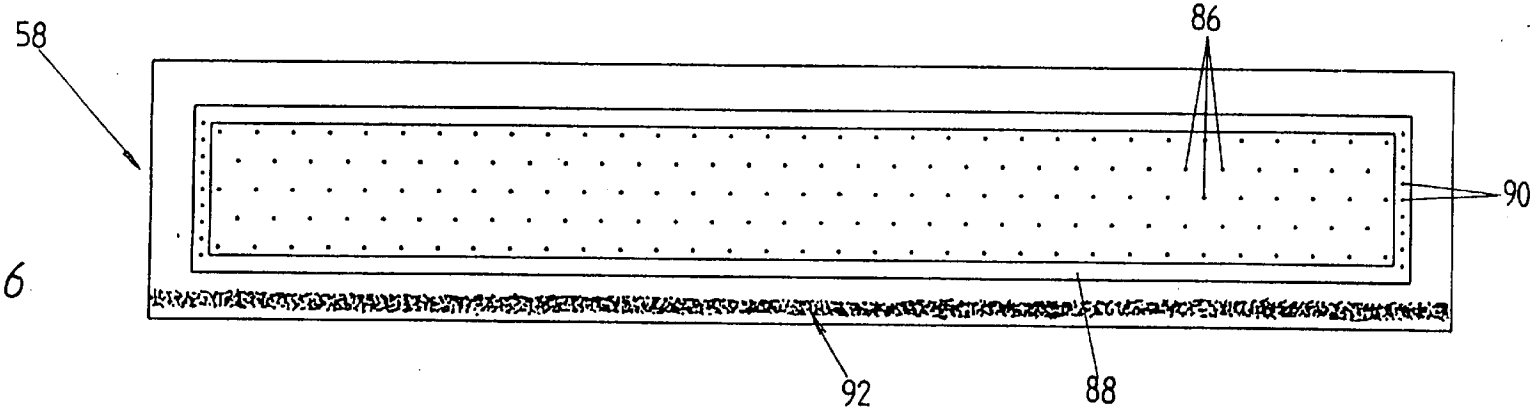
FIG. 6 is a bottom plan view of a nozzle box disposed above the extraction or suction and air deflection trough shown in FIG. 2.
Figure 7:
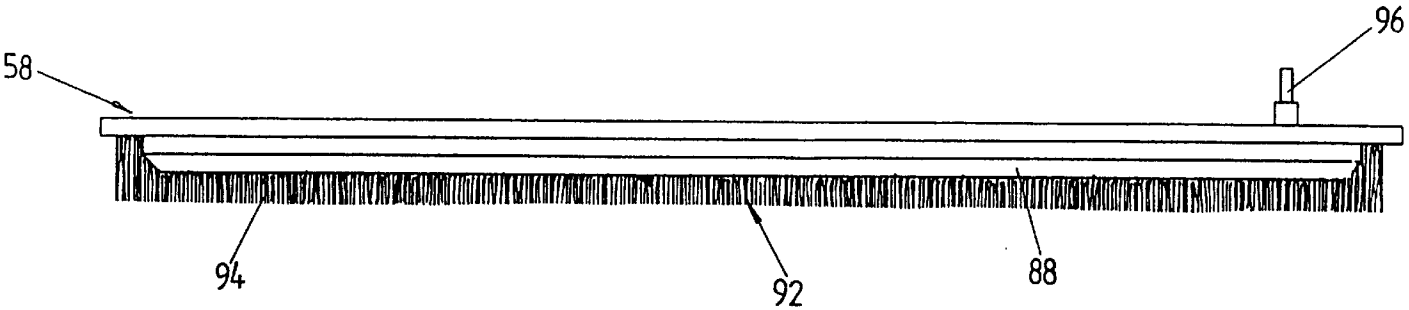
FIG. 7 is a side elevational view of FIG. 6.
Figure 8:
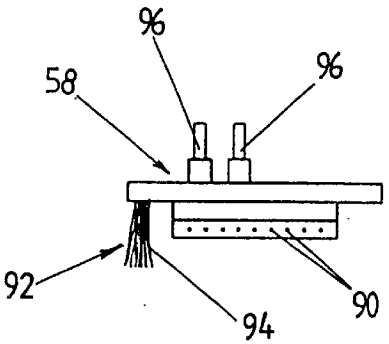
FIG. 8 is an end elevational view of FIG. 6.

As best illustrated in FIGS. 5 to 7, the nozzle box 58 serving as an air feeding device includes a flat metal housing which, on the flat underside thereof facing towards the empty strand 36, is provided with a large number of air outlet nozzles 86, by which the sheet grippers 18 of the chain conveyor 20 passing under and through the nozzle box 58 can be showered with air. The air outlet nozzles 86 are arranged in parallel rows, of which the central row is located precisely above the elevation 68 on the top of the extraction or suction and air deflection trough 56.

Adjoining the flat underside, a bordering edge 88 of a small lower part of the nozzle box 58 is beveled and, on the narrower ends thereof, is respectively provided with a row of nozzle openings 90 which serve to shower the chains of the chain conveyor 20 with air. The larger upper part of the nozzle box 58 is provided with a surrounding shoulder, the narrower ends of which rest on the side cheeks of the chain delivery. Applied to the underside of the shoulder is a brush 92 having bristles 94 extending downwardly into the path of the empty strand 36. The brush 92 likewise extends over the entire width of the chain delivery and the housing 24 and, in the direction of motion of the empty strand 36, is disposed immediately downline from the brush 76 of the extraction or suction and air deflection trough 56.

The nozzle box 58 or a closed upper housing wall or cover arranged around the latter, the extraction or suction and air deflection trough 56 in the intermediate space between the empty strand 36 and the conveying strand 30, and the two side walls of the sheet delivery system 22 which carry the guides 28 bound or define a flow path underneath the nozzle box 58, the flow path being completely blocked transversely to the direction of motion of the empty strand 36 by the brushes 76, 92 and an air curtain flowing from the nozzle box 58 towards the extraction or suction and air deflection trough 56, the defining boundaries of the flow path preventing any lateral escape of the powder-laden air flow.

Compressed air at a pressure between 1.5 and 3.5 bar is applied to the nozzle box 58 through two air feed nozzles 96 at the top of the nozzle box 58, each of which communicates with part of the rows of nozzles 86. The amount of air that is fed is of such measure that only a part thereof can be sucked in again through the suction slots 70 of the extraction or suction and air deflection trough 56, while the remaining air is deflected in the direction towards the printing machine at the top of the extraction or suction and deflection trough 56.

During the operation of the printing machine 2 and the sheet delivery system 22, the air is fed in at a relatively low pressure of 1.5 to 2 bar, while the air pressure during the subsequent cleaning of the sheet delivery system 22 is increased to 3 to 3.5 bar. Directional valves in nonillustrated air feed lines leading to the air feed nozzles 96 permit cyclic feeding of air and selective feeding of air, respectively, to each individual one of the two air feed nozzles 96 or to both together, i.e., respectively, to some of the nozzles 86 or to all of the nozzles 86.

The air blown downwards out of the nozzle box 58 flows past the sheet grippers 18 and the chains of the chain conveyor 20, and showers these with clean fresh air, adhering powder particles being entrained downwardly, so that they cannot be transported farther in the direction towards the printing machine 2 by the empty strand 36. At the same time, the air flow that is guided downwardly forms a barrier in this region of the sheet delivery system 22 between the closed housing top, the side walls of the sheet delivery system 22 and the extraction or suction and air deflection trough 56 on the underside, the barrier preventing powder-laden air that has passed through the brushes 76, 92 from flowing along the empty strand 36 in the direction towards the printing machine 2.

While some of the fed-in air, together with the powder particles which have been cleaned off, is extracted or sucked through the suction slots 70 of the two central rows of slots on the top of the extraction or suction and deflection trough 56 and the associated suction ducts 72, and is cleaned in the dust separator downline, in the case of the sheet delivery system 22 in FIG. 1, the remaining air at the top of the trough 56 is deflected in the direction of motion of the empty strand 36, flowing past and above the powder device 50, in the direction towards the printing machine. Consequently, between that outer edge of the extraction or suction and air deflection trough 56 which is adjacent to the powder device 50, and the top of the powder device 50 underneath the empty strand 36, a fresh-air cushion is formed (illustrated by arrows in FIG. 1), which extends beyond the powder device 50 and far into the oblique portion of the chain delivery and prevents the spread of swirled powder in this direction.

Between the powder device 50 and the printing machine 2, on the underside of the air cushion facing the conveying strand 30, air vortices are formed, probably due to the air suction of the conveying strand 30, which result in a reversal of the fresh-air flow directly above the printed sheets in the direction towards the free end of the delivery 22, and which force the powder emerging from the powder device 50 in the vicinity of the conveying strand 30 away from the printing machine 2 in a direction towards the deflection of the conveying strand 30. Consequently, a spreading of swirled powder is reliably prevented here too, and the powder is kept in the vicinity of the powder device 50.

Between the powder device 50 and the suction slots 70 arranged on the adjacent outer edge of the extraction or suction and air deflection trough 56, fresh-air vortices are likewise formed as a result of the vacuum applied thereat; at the underside of the vortices, the air likewise flows back to the front in the opposite direction towards the trough 56 and carries therewith some of the swirled powder so that the latter can be extracted or sucked through the suction slots 70 on the adjacent outer edge of the trough 56.

Due to the interruption of the air flow along the empty strand 36, on the printing machine side of the brushes 76, 92, the production of a vacuum may occur having an intensity that depends upon the amount of air fed through the nozzle box 58. In order to prevent powder-laden air from the powder dusting device from being sucked up by this vacuum, in the case of the sheet delivery system 22 illustrated in FIG. 2, an air grating 95 is disposed at the upper end of the oblique portion of the housing 24, in the upper wall of the housing 24, through which air not laden with powder can be sucked from the surroundings of the sheet delivery system 22 into the interior of the housing 24. The major part of the air that is sucked in is entrained by the suction of the empty strand 36, along the latter, in the direction towards the printing machine 2, while a smaller part flows downwardly behind the air extraction or suction pipe 75, serving as an air diverter, and on the printing machine side flows downwardly along the powder device 50. The part of the air blown-in by the nozzle box 58 and deflected at the top of the extraction or suction and air deflection trough 56 flows downwardly on that side of the powder device 50 that faces away from the printing machine 2, the two air flows likewise contributing to the conveyance of the powder out of the powder device 50 downwardly towards the surface of the sheets transported past and to preventing the swirling and spreading of powder.

Instead of a nozzle box 58 disposed above the extraction or suction and air deflection trough 56 in order to blow air in, and an air entry opening 95 located at a distance downline, a nonillustrated air entry opening located above the extraction or suction and air deflection trough 56 can also be provided. Because of the air being sucked in on the underside of the empty strand 36, air not laden with powder is sucked in through this opening into the interior of the housing 24 from the surroundings of the sheet delivery system 22, and then flows in a vertical direction through the path of movement of the empty strand 36.

Furthermore, air can also be extracted upline from the brushes 76, 92 so that by a vacuum produced thereat, a minor part of the air fed in downline of the brushes 76, 92 is sucked forward through the brushes 76, 92. In addition, the brushes 76, 92 can also be omitted, and the airflow extending along the empty strand 36 can be interrupted only by the feed and/or extraction or suction of air.

The measures previously described in particular prevent swirled powder from being entrained by the suction of the chain conveyor 20 and from being transported in the direction towards the printing machine 2 by an air flow generated above and below the empty strand 36 of the chain conveyor 20 within the housing 24 of the sheet delivery system 22. The spread of powder is essentially limited to the area underneath the powder device 50 and above the printed sheets passing under the latter, as a result of which, on the one hand, the consumption of powder can be reduced considerably and, on the other hand, dust loading both in the ambient air and in the interior of the housing is significantly lower. By restricting the powder to the aforementioned region, it is additionally possible, in the case of sheets which are printed on both sides thereof, for the uniform dusting of the front and back of the sheets to be improved.

In addition, the fresh-air cushion between the conveying strand 30 and the empty strand 36 on that side of the powder device 50 that faces towards the printing machine 2 accelerates the oxidative drying of the printing inks by the continuous feeding of fresh air into this region.

Furthermore, due to the air showering, the chains and guide rails 28 of the chain conveyor 20 remain clean and saturated with grease, so that wear caused by powder can be prevented.

The two brushes 76 and 92 serve to brush off powder particles or powder agglomerates which adhere very firmly to the chains or sheet grippers 18, the particles or agglomerates then falling down into the hollows 66 in the extraction or suction and deflection trough 56 and being extracted or sucked through the two suction slots 70 of the two central rows of slots.

I claim:

1. A method for conveying printed sheets, which comprises:

conveying printed sheets through a delivery housing of a printing machine with a chain conveyor having gripper systems, a conveyor transport-run operatively running along a first conveyor path in a sheet transport direction and a conveyor return-run running along a second conveyor path in a reverse direction, and simultaneously dusting the printed sheets with a powder by using a dusting device and preventing uncontrolled spread of excess powder borne by an air flow induced by the conveyor return-run;

limiting the air flow by using side walls of the delivery housing and an upper limiting device disposed above the conveyor return-run and a lower limiting device disposed below the conveyor return-run between the conveyor transport-run and the conveyor return-run;

defining an interruption location with the upper and lower limiting devices at the second conveyor path; and interrupting the air flow at the interruption location.

2. The method according to claim 1, which comprises blocking the air flow substantially completely by using at least one of a mechanical and a pneumatic device.

3. The method according to claim 1, which comprises adapting the conveyor transport-run and the conveyor return-run to form an ascending conveyor section and a subsequent conveyor section deflected to a horizontal course with respect to a sheet transport direction; and assigning the interruption location to the subsequent conveyor section.

4. The method according to claim 1, which comprises pivoting a stack lifting mechanism shaft at the side walls and providing the interruption location above the shaft.

5. The method according to claim 1, which comprises feeding non-powder laden air into the housing in a manner that the air flows through the conveyor return-run transversely to the running direction thereof, to interrupt the air flow.

6. The method according to claim 5, which comprises feeding the air into the housing from a location above the conveyor return-run.

7. The method according to claim 5, which comprises interrupting the air flow by using a brush device and feeding in the air with respect to the running direction of the conveyor return-run downstream of the brush device.

8. The method according to claim 5, which comprises deflecting at least a certain amount of the air fed-in, to flow in the reverse direction.

9. The method according to claim 8, which comprises guiding at least a certain amount of the deflected air to flow over and past the dusting device.

10. The method according to claim 1, which comprises extracting powder-laden air in a vicinity of the interruption location, to interrupt the air flow.

11. The method according to claim 10, which comprises feeding non-powder laden air into the housing causing the air to flow through the conveyor return-run transversely to the running direction thereof and extracting at least a certain amount of the air fed-in after the fed-in air has passed through the conveyor return-run.

12. The method according to claim 6, which comprises extracting at least a certain amount of the fed-in air nearly opposite the location at which it is fed into the housing.

13. The method according to claim 11, which comprises extracting at leapt a certain amount of the fed-in air nearly opposite the location at which it is fed into the housing.

14. The method according to claim 1, which comprises interrupting the air flow by using a brush device and extracting the powder-laden air in a vicinity of the brush device.

15. The method according to claim 1, which comprises sucking air into the housing from outside through at least one air opening in the running direction of the conveyor return-run, in a region of at least one of the interruption location and a location downstream thereof.

16. The method according to claim 2, which comprises interrupting the air flow by using a brush device at least nearly completely blocking the air flow.

17. A sheet-fed printing machine, comprising:

at least one printing unit;

a sheet delivery including a housing having side walls;

a piling station for piling a stack of sheets;

a dusting device disposed within said housing for powdering printed sheets;

an operatively revolving chain conveyor mounted within said housing and having gripper systems and a conveyor transport-run operatively running in a direction towards said piling station, said conveyor transport-run transporting printed sheets from said printing unit to said piling station;

a conveyor return-run operatively running along a conveyor path in a reverse direction, causing a dust laden air flow directed towards said printing unit in the surroundings of said conveyor return-run;

an upper limiting device adapted for limiting the dust laden air flow above said conveyor return-run;

a lower limiting device adapted for limiting the dust laden air flow below said conveyor return-run;

said lower limiting device being disposed below said conveyor return-run between said conveyor transport-run and said conveyor return-run;

said limiting devices extending across the width of said housing and defining an interruption location at said conveyor path of said conveyor return-run; and interrupting devices adapted for interrupting the dust-laden air flow at said interruption location.

18. The printing machine according to claim 17, wherein said interrupting devices include at least one of a mechanical and a pneumatic device, which at least nearly completely blocks the dust-laden air flow limited by said side walls and said upper and lower limiting devices.

19. The printing machine according to claim 17, wherein said interrupting devices include at least one air feed device for feeding non powder laden air into the housing, causing the air to flow through said conveyor return-run transversely to the running direction of said conveyor return-run.

20. The printing machine according to claim 17, wherein said interrupting devices include at least one extraction device, having a top, for extracting dust-laden air in a region of said interruption location.

21. The printing machine according to claim 19, wherein said interrupting devices include at least one extraction device, said extraction device is disposed at least nearly opposite said air feed device for extracting at least a certain amount of the air fed into the housing by said air feed device after the air has passed through said conveyor return-run.

22. The printing machine according to claim 21, wherein said extraction device and said air feed device are arranged above one another.

23. The printing machine according to claim 20, wherein said extraction device is disposed underneath conveyor return-run and has at least one suction opening at said top of said extraction device, said top of said extraction device faces toward said conveyor return-run.

24. The printing machine according to claim 19, wherein said interrupting devices include a brush device.

25. The printing machine according to claim 24, wherein said air feed device is disposed downstream of said brush device with respect to the running direction of said conveyor return-run.

26. The printing machine according to claim 20, wherein said interrupting devices include a brush device disposed in a vicinity of said extraction device.

27. The printing machine according to claim 24, wherein said brush device includes at least two brushes having at least one of overlapping bristles and touching bristles in said conveyor path of said conveyor return-run.

28. The printing machine according to claim 17, wherein, in a region of at least one of said interruption location and a location downstream thereof in the running direction of said conveyor return-run at least one air opening is provided, non powder laden air is sucked into said housing through said at least one air opening.

29. The printing machine according to claim 28, wherein said air opening is located above said conveyor return-run.

30. The printing machine according to claim 17, wherein said interrupting devices and said limiting devices are mounted in the running direction of said conveyor transport-run, downstream of said dusting device.

31. The printing machine according to claim 17, wherein said conveyor transport-run and said conveyor return-run establish an ascending conveyor section and a subsequent conveyor section, deflected to a horizontal course with respect to the running direction of said conveyor transport-run, and said limiting devices and said interrupting devices are assigned to said subsequent conveyor section.

32. The printing machine according to claim 17, including a blowing device formed by one of a blower and an air-nozzle device, said blowing device being provided for blowing the sheets downwardly onto the stack of sheets; said limiting devices and said interrupting devices being disposed vertically above said blowing device.

33. The printing machine according to claim 31, wherein said interrupting devices and said limiting devices are mounted, with respect to the running direction of said conveyor transport-run, downstream of said ascending conveyor section.

34. The printing machine according to claim 17, wherein a stack lifting mechanism shaft is pivoted at said side walls, said interrupting devices and said limiting devices are mounted at least at one of locations above and upline and downline of said shaft.

35. The printing machine according to claim 19, including a deflection device mounted underneath said conveyor return-run, said deflection device deflecting at least a certain amount of the air fed in by said air feed device in a direction towards said printing unit.

36. The printing machine according to claim 19, including devices for cleaning the air fed in by said air feed device.

37. The printing machine according to claim 21, including devices for cleaning the air fed in by said air feed device.

38. The printing machine according to claim 22, including devices for cleaning the air fed in by said air feed device.

39. The printing machine according to claim 23, including devices for cleaning the air fed in by said air feed device.

40. The printing machine according to claim 25, including devices for cleaning the air fed in by said air feed device.

41. The printing machine according to claim 35, including devices for cleaning the air fed in by said air feed device.

42. The printing machine according to claim 20, including devices for cleaning the dust-laden air extracted by said extraction device.

43. The printing machine according to claim 21, including devices for cleaning the duet-laden air extracted by said extraction device.

44. The printing machine according to claim 22, including devices for cleaning the dust-laden air extracted by said extraction device.

45. The printing machine according to claim 23, including devices for cleaning the dust-laden air extracted by said extraction device.

46. The printing machine according to claim 26, including devices for cleaning the dust-laden air extracted by said extraction device.

* * * * *